United States Patent [19]

Verreet

[11] 4,454,708

[45] Jun. 19, 1984

[54] WIRE ROPE AND METHOD OF MAKING SAME

[75] Inventor: Roland Verreet, Kirkel, Fed. Rep. of Germany

[73] Assignee: Drahtsteilwerk Saar GmbH, Limbach, Fed. Rep. of Germany

[21] Appl. No.: 372,754

[22] Filed: Apr. 28, 1982

[30] Foreign Application Priority Data

May 2, 1981 [DE] Fed. Rep. of Germany ..... 3117452

[51] Int. Cl.[3] ..... D07B 1/00; D07B 1/06; D07B 5/00

[52] U.S. Cl. ..... 57/215; 57/9

[58] Field of Search ..... 57/9, 214, 215, 219

[56] References Cited

U.S. PATENT DOCUMENTS 2,181,341 11/1939 Reardon ..... 57/215 X
3,083,817 4/1963 Campbell ..... 57/215 X
3,130,536 4/1964 Peterson et al. ..... 57/9
3,729,921 5/1973 Stroh ..... 57/215 X
4,311,001 1/1982 Glushko et al. ..... 57/9 X

FOREIGN PATENT DOCUMENTS 632783 11/1978 U.S.S.R. ..... 57/9

*Primary Examiner*—Donald Watkins
*Attorney, Agent, or Firm*—Peter K. Kontler

[57] ABSTRACT

A wire rope, particularly a non-twistable wire rope, wherein an annulus of outer strands surrounds a wire rope center with a central strand and one or more annuli of neighboring strands surrounding the central strand. The wires of the strands in the center do not intersect each other. The entire center or at least some of its strands are densified prior to or during application of the outer strands. Alternatively, or in addition to such densification, at least some strands of the center are assembled of wires having an other than circular outline to thereby reduce the combined cross-sectional area of voids in the center.

6 Claims, 1 Drawing Figure

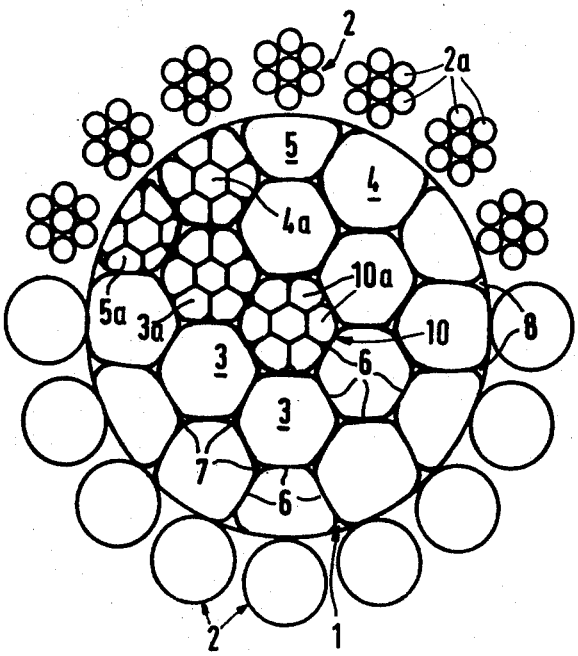
2
2a
5
4
4a
10a
5a
3a
10
8
3
6
3
7
6
2
1

WIRE ROPE AND METHOD OF MAKING SAME

BACKGROUND OF THE INVENTION

The present invention relates to wire ropes in general, and more particularly to improvements in wire ropes of the type wherein at least one annulus or set of outer strands surrounds a wire rope center having several strands which consist of or comprise wires and do not cross or intersect one another. Still more particularly, the invention relates to a wire rope wherein the center preferably consists of or comprises a central strand and one or more annuli of neighboring strands which surround the central strand. The neighboring strands of the center preferably extend in parallelism with one another, and the wires of the strands in the center are preferably also parallel to each other, i.e., the outer wires of the neighboring strands in the center are preferably oriented in such a way that they do not intersect or cross each other. Still more particularly, the invention relates to a wire rope which is preferably of the non-twistable character or which can be twisted only to a small or negligible degree.

OBJECTS AND SUMMARY OF THE INVENTION

An object of the invention is to provide a wire rope which can stand pronounced breaking stresses.

Another object of the invention is to provide a wire rope which can stand pronounced flexural stresses.

A further object of the invention is to provide a wire rope which can be assembled or produced in a simple and inexpensive way.

An additional object of the invention is to provide a method of producing a wire rope which exhibits the above outlined advantageous features and characteristics.

Still another object of the invention is to provide a novel and improved method of treating the center of a wire rope prior to or during application of a set of outer strands around the center.

Another object of the invention is to provide a wire rope wherein the percentage of voids in the center and/or between the center and the surrounding strands is less than in heretofore known wire ropes.

A further object of the invention is to provide a wire rope wherein the wear in the region of contact between the center and the strands surrounding the center is less pronounced than in heretofore known wire ropes.

An additional object of the invention is to provide a wire rope whose desirable characteristics can be improved without any aftertreatment of the center and/or other components or constituents thereof.

Still another object of the invention is to provide a wire rope which is assembled and treated in such a way that the deterioration or destruction of its center does not progress more rapidly than the deterioration or destruction of other components and, in fact, can be less pronounced than that of the strands which are disposed around the center and contact pulleys, rollers and/or like devices when the wire rope is in actual use.

One feature of the invention resides in the provision of a wire rope which comprises a wire rope center and an outer layer comprising a set of strands which surround the center. The center includes a plurality of neighboring strands and at least some strands of the center have an other than circular cross-sectional outline and facetted peripheral surfaces. The facets or flats of neighboring non-circular strands in the center abut against each other.

The center further comprises or can further comprise a center strand, and the aforementioned neighboring strands of the center then confine and form one or more annuli around the center strand. The wires of strands in the center do not cross each other, i.e., they are at least substantially parallel to one another.

At least some of the strands in the center can be densified, i.e., the presence of facets on some or all of the strands in the center can be attributed to densification of the center. Alternatively, the strands of the center can be assembled of wires having an other than circular cross-sectional outline. This renders it possible to reduce the combined cross-sectional area of voids in the center by appropriate configuration of the wires and by appropriate assembly of strands which include such wires.

Another feature of the invention resides in the provision of a method of making a wire rope wherein a set of outer strands surrounds a wire rope center having a plurality of neighboring strands. The method comprises the step of assembling at least some strands which constitute the center from wires having an other than circular cross-sectional outline. Alternatively, the method comprises the step of densifying the entire center so as to reduce the combined cross-sectional area or percentage of voids therein. The just mentioned densifying method can be carried out prior to the application of outer strands around the center, during application of outer strands around the center, or during assembly of strands which form part of the center.

The novel features which are considered as characteristic of the invention are set forth in particular in the appended claims. The improved wire rope itself, however, both as to its construction and the mode of making the same, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a somewhat schematic transverse sectional view of a wire rope which embodies the present invention.

DESCRIPTION OF THE PREFERRED EMBODIMENTS

The drawing shows a wire rope which has a wire rope center 1 and an annulus or set of outer strands 2 each of which consists of or includes seven wires 2*a*. The center 1 has an at least substantially circular outline and includes a centrally located central strand 10 having seven parallel wires 10*a*, an inner annulus of neighboring strands 3 each of which has seven wires 3*a*, and an outer annulus consisting of alternating strands 4 and 5 each of which has seven wires (4*a*, 5*a*) each having a non-circular (i.e., other than circular) outline. The outer strands 2 are normally formed and laid around the center 1 after the latter is fully assembled, and such outer strands are twisted in the opposite direction.

The center 1 is made in accordance with a so-called parallel lay technique (Seale or Warrington type rope design). As mentioned above, this center comprises the centrally located central strand 10 and the strands 3, 4 and 5 which can be laid simultaneously and are parallel to one another. Each of the strands 3, 4 and 5 is a so-called normal strand, i.e., it includes a central wire (*3a*, *4a*, *5a*) and a group of six wires (*3a*, *4a*, *5a*) around the respective central wire. Initially, the diameters of all of the wires *3a*, *4a* or *5a* are the same. However, the cross-sectional areas of the strands 4 (each of which is disposed between two neighboring strands 3) are larger than those of the strands 5 (the strands 5 are outwardly adjacent to the respective strands 3).

The center 1 is densified. This can be readily seen in the drawing. Thus, the center wires *4a* and *5a* of the strands 4 and 5 are shifted out of the exact center, and the outlines of the wires *3a*, *4a* and *5a* deviate from circles. In other words, the strands 3, 4 and 5 (as well as the central strand 10) exhibit facets 6 and the facets 6 of neighboring strands in the center 1 abut against each other. This reduces the combined cross-sectional area of voids within the strands 10, 3, 4 and 5 as well as the combined area of voids 7 between the neighboring strands of the center. Each of the wires 10*a*, *3a*, *4a*, *5a* is assumed to have had a circular outline prior to densification of the center 1. This means that not only the strands 10, 3, 4 and 5 are formed with facets or flats but that at least some or all of the wires 10*a*, *3a*, *4a* and *5a* are also out of round. However, the outline of the center 1 as a whole is or closely approximates a circle. The periphery of the center 1 is formed with relatively shallow recesses or grooves 8 which extend lengthwise of the strands 4 and 5.

The diameters of the strands 2 which form the set of outer strands are smaller than those of the strands 3, 4, 5 and 10. Also, and as can be seen in the drawing, the wires *2a* of the strands 2 are elongated cylinders without facets, i.e., the wires *2a* and the strands 2 are not deformed or densified.

The illustrated wire rope is one which can be defined as (1+6+)(6+6))+16 class wire rope, i.e., a wire rope with a total of thirtyfive strands (1+6+6+6 in the center and 16 around the center). However, this is merely an example, i.e., the total number of strands (and/or wires in the strands) can be increased or reduced without departing from the spirit of the invention.

If the strands of one or both annuli of strands (3 and 4, 5) which form part of the center 1 are assembled of wires having an other than circular cross-sectional outline, the percentage of voids in such strands is relatively low (e.g., substantially the same as if the entire center 1 were densified during its assembly or prior to or during assembly with the strands 2). This is due to the fact that the configuration of wires *3a*, *4a* and *5a* can be readily selected with a view to reduce the voids in the strands 3, 4 and 5 to zero or to a fraction of voids which are present when a strand is assembled of wires which constitute elongated cylinders. The number of facets or flats on each of the wires in the center 1 or on some of such wires will be selected in dependency on the desired quantity of metallic material per unit length of the strands, i.e., on the desired compactness or mass of the strands in the center. The facets of neighboring wires in the strand 3, 4 or 5 and/or in the strand 10 are in at least partial contact with each other, e.g., not unlike the cells of a honeycomb. The resistance to breakage increases with the increasing mass per unit length of the strands in the center 1, i.e., proportionally with a reduction of the combined volume of voids in such strands. The feature that the strands 10, 3, 4 and/or 5 are or can be assembled of wires having a polygonal cross-sectional outline contributes to an increase of the area of contact between neighboring wires of a strand and hence of the flexibility of the strand. The exact magnitude or extent of resistance to breakage and the exact flexibility of the improved wire rope depend on the aforediscussed as well as on certain other factors, such as the number of strands in the center, the material of the wires, the number of wires in each strand, the diameters of the wires and/or others. As regards the relative increase in flexibility and in resistance to breakage, this depends on the type of conventional wire ropes with which the improved wire rope is compared. The same applies for the manufacturing cost of the improved wire rope. However, it has been found that at least one such characteristic of the improved wire rope is superior irrespective of the type of conventional wire ropes with which the improved wire rope is compared.

It goes without saying that the wire rope which is shown in the drawing can be modified in a number of ways without departing from the spirit of the invention. For example, at least one of the strands which form part of the center 1 can be assembled of six symmetrical wires having a triangular cross-sectional outline, e.g., in a manner similar to subdividing a circle into six equal sectors each of which has three straight sides. It is equally possible to assemble each strand or some strands of the center 1 from, for example, three wires each of which has an oval or substantially or approximately oval cross-sectional outline. It is also possible to assemble at least one strand of the center 1 of polygonal central wire and of a set of substantially segment-shaped wires which surround the polygonal central wire.

At the present time, the center 1 is preferably produced by densification of its strands 10, 3, 4 and/or 5 subsequent to completed assembly of the center. The densification can be carried out by resorting to conventional techniques, such as drawing, hammering, rolling and/or others. Densification of the entire center 1, i.e., after completed assembly of its strands into a prefabricated body, contributes to simplicity and lower cost of the densifying step and renders it possible to perform the densifying operation by resorting to relatively simple machines. It is evident that the strands 10, 3, 4 and/or 5 can be assembled of wires having an other than circular cross-sectional outline, i.e., a reduction of the percentage of voids in the center 1 can be promoted by assembling each of its strands from wires having an other than circular cross-sectional outline to thus reduce the percentage of voids in each such strand prior to the densifying step. The densifying step then promotes a reduction or elimination of voids (7) which develop or which were present between neighboring strands so that the finished center is at least substantially free of voids or the percentage of voids therein is a very small fraction of such percentage in a conventional center. Still further, it is equally within the spirit of the invention to assemble the center from strands each of which has a polygonal cross-sectional outline as a result of densification prior to assembly with other strands or as a result of such selection of wires therein that the strand is at least substantially free of voids with or without densification prior to assembly with other strands of the center. In many instances, the strands of the center 1 can be densified by drawing or rolling in such a way that they exhibit a substantially circular cross-sectional outline prior to assembly with other strands of the center. Still further, the center 1 can be assembled from a wide variety of strands, namely, of one or more strands having a circular cross-sectional outline as a result of or due to the absence of densification and one or more strands having a polygonal cross-sectional outline as a result of or without any densification. The thus assembled densified and non-densified strands, or strands some of which have and the other of which do not have a circular cross-sectional outline, are thereupon subjected to a densifying action (if necessary) to further reduce the combined percentage of voids in the finished center. The utilization of strands 3, 4, 5 and/or 10 which have a polygonal cross-sectional outline, or at least some of which underwent a densifying treatment prior to assembly with other strands of the center, results in a center whose density is especially high, i.e., which consists practically exclusively of metallic material and whose characteristics are even more superior to those of conventional centers or wire ropes embodying conventional centers. Of course, the manufacturing cost is increased if a substantial number or all of the strands which form the center must undergo a densifying action prior to assembly into a finished center and prior to densification of the assembled center.

It has been found that the quality of the center (as regards the reduction or elimination of voids therein) can be improved to a surprising degree by the simple expedient of assembling the center of non-densified strands and by thereupon densifying the assembled center. The extent to which the combined volume of voids is reduced is surprisingly high, even if the densification does not result in pronounced deformation and resulting compacting of strands of which the center is assembled, i.e., if the densification of the assembled center merely results in a reduction of the combined volume of voids 7 between (but not necessarily within) the strands of the finished center. Thus, highly satisfactory results can be achieved by the simple expedient of assembling the center 1 of conventional strands which did not undergo any preliminary compacting action, and by thereupon densifying the resulting center. Such procedure is relatively inexpensive and the center can be finished with little loss in time because its constituents need not be densified or compacted individually but only once, namely, during or subsequent to completed assembly of the center.

It will be readily appreciated that the strands of the center and the wires in such strands should not cross or intersect each other prior to densification of individual strands and/or during densification of the assembled center. The center can have a single layer of strands, or the strands of each layer are parallel to each other (this is the so-called parallel lay). At the very least, crossing of wires in the strands of the center 1 is undesirable; each strand should have a single layer of wires, or the wires in each layer of the strand should be parallel to one another. Such strands are known as parallel lay strands. By appropriate selection of the length of lays and the direction of twist, one can further prevent a crossing of outer wires in superimposed or neighboring strands. Therefore, a wire rope with a wire rope center which latter is assembled in accordance with the so-called parallel lay technique from parallel lay strands and without crossing of the outer wires in successive strands has been found to be particularly suitable for treatment in accordance with the improved method. Such a wire rope exhibits (in comparison with conventional one-layer wire ropes) the important advantage that the densifying action is felt much more than by the densifying of other types of cores.

It was also found that the improved method is particularly desirable for the treatment of non-twistable or only slightly twistable wire ropes. The densifying action to which the center is subjected (with or without preceding densification of strands which are assembled to form the center) enhances the resistance to twisting.

It was already proposed to produce a wire rope in accordance with the so-called parallel lay technique by assembling it from parallel lay strands which, as a result of compacting of the entire wire rope, exhibit flats or facets which are in contact with one another. The facets develop as a result of compacting in regions where the neighboring strands contact each other. These wire ropes also exhibit certain desirable characteristics, such as high density (i.e., a relatively high percentage of metallic material per unit length and hence a relatively low percentage of voids per unit length), pronounced flexibility and relatively low cost. However, such treatment of a fully assembled wire rope also exhibits certain serious drawbacks. Thus, the densifying operation which is performed upon a fully assembled wire rope necessarily entails at least some deformation of the outer strands corresponding to the strands 2 of the improved wire rope. Deformation of the outer strands normally results in disappearance of pronounced longitudinally extending ridges which are formed by the outer wires of the outer strands (such as the wires 2*a* of the strands 2 shown in the drawing). Consequently, the outline of the fully assembled deformed wire rope resembles a relatively smooth cylinder whose outer layer is subjected to less pronounced wear as a result of engagement with ribbed or otherwise configurated contact surfaces of guide rolls, pulleys, hoists and similar devices. Thus, the exterior of such wire rope deteriorates at a slower rate than the interior of the wire rope so that the attendants often fail to replace the wire rope in time because the exterior of the wire rope does not furnish any indication of the progress of deterioration of the center. Otherwise stated, the center of such conventional wire rope deteriorates much more rapidly than the layer or layers which surround the center. This can lead to serious accidents and injuries.

In accordance with the present invention, the wire rope is densified, at least in part, in such a way that the smooth surface of the finished (densified) center 1 is out of contact with pulleys, guide rolls and like devices over which the wire rope is trained. These devices are contacted by the strands 2 which are not densified and, therefore, their wires 2*a* constitute longitudinally extending ribs or ridges which contact the guide rolls, pulleys, etc. and thus undergo a reasonable amount of wear or, at the very least, the wear upon the strands 2 is not less pronounced than the wear upon or the progress of deterioration of the center 1. In other words, the smooth external surface of the densified center 1 is surrounded by a set of strands 2 which are not densified or which are not densified to such an extent that they would present a smooth or relatively smooth external surface for contact with rolls, reels or similar devices. Densification of the center 1 prolongs the useful life of the center and it further ensures that the most sensitive or most affected portion of the wire rope (namely, the region of contact between the center 1 and the strands 2 therearound where the wires 2*a* of the strands cross the wires 4*a*, 5*a* of the strands 4 and 5) is subjected to less pronounced stresses than in conventional wire ropes. This results in considerable lengthening of the useful life of the entire wire rope.

The strands 2 may constitute commercially available conventional strands, or at least some of these strands can be subjected to a certain amount of (and even pronounced) densification. It is often preferred to make the entire wire rope of one and the same type of strands. Thus, the strands 2 can be identical with the strands 10, 3, 4 and 5 except that the strands 2 are subjected to a less pronounced compacting action or are not compacted at all. As mentioned above, the center 1 can be densified during its assembly, during assembly with the strands 2, or in a separate operation which is carried out subsequent to its completion but prior to its assembly with the strands 2.

In comparison with a conventional wire rope which can be twisted and which is assembled of densified strands, i.e., whose center is not densified as a unit or in its entirety, the improved wire rope has the same or nearly the same cross-sectional area and offers the same or nearly the same resistance to breaking stresses but a greater flexibility and it can be produced at a lower cost. Furthermore, the improved wire rope, whose center is densified in its entirety, can be assembled of relatively thin or small-diameter strands which cannot be readily densified per se, i.e., prior to assembly into a wire rope center.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A wire rope of at least substantially non-twistable character, comprising a densified wire rope center and an outer layer comprising undensified strands which surround the center, said center including a plurality of neighboring strands and at least some strands of said center having an other then circular cross-sectional outline and facetted peripheral surfaces, at least some strands of said center having wires of other than circular cross-sectional outline and the facets of neighboring strands in the center abutting against each other, at least some strands of said center being twisted in one direction and the strands of said outer layer being twisted in the opposite direction.

2. The wire rope of claim 1, wherein the center further comprises a central strand, said neighboring strands of the center surrounding said central strand.

3. The wire rope of claim 1, wherein the strands of the center have wires which do not cross each other.

4. The wire rope of claim 1, wherein the strands of the center have parallel wires.

5. A method of making a wire rope of at least substantially non-twistable character wherein a set of undensified outer strands surrounds a wire rope center having a plurality of neighboring strands, comprising the steps of assembling at least some strands of the center from wires having an other than circular cross-sectional outline, assembling the center from strands at least some of which have an other than circular outline, at least one of said assembling steps including densifying said at least some strands and/or said center, applying the outer strands around the center subsequent to said densifying step, twisting at least some strands of the center in one direction, and twisting the outer strands in the opposite direction.

6. The method of claim 5, wherein said densifying step is carried out during assembly of strands forming part of the center.

* * * * *